US008726699B2

(12) United States Patent
Lonati et al.

(10) Patent No.: US 8,726,699 B2
(45) Date of Patent: May 20, 2014

(54) CIRCULAR KNITTING MACHINE FOR MEN'S SOCKS, OF THE TYPE WITH NEEDLES ON THE DIAL

(75) Inventors: Ettore Lonati, Brescia (IT); Tiberio Lonati, Brescia (IT); Fausto Lonati, Brescia (IT)

(73) Assignee: Santoni, S.p.A., Brescia (IT)

( * ) Notice: Subject to any disclaimer, the term of this patent is extended or adjusted under 35 U.S.C. 154(b) by 0 days.

(21) Appl. No.: 13/880,800

(22) PCT Filed: Dec. 23, 2011

(86) PCT No.: PCT/IB2011/055936
§ 371 (c)(1),
(2), (4) Date: Apr. 24, 2013

(87) PCT Pub. No.: WO2012/093316
PCT Pub. Date: Jul. 12, 2012

(65) Prior Publication Data

US 2013/0269394 A1 Oct. 17, 2013

(30) Foreign Application Priority Data

Jan. 5, 2011 (IT) ..... BS2011A0001

(51) Int. Cl.
*D04B 9/06* (2006.01)

(52) U.S. Cl.
USPC ..... 66/19

(58) Field of Classification Search
CPC ..... D04B 9/06; D04B 9/065; D04B 9/08; D04B 9/44; D04B 9/22; D04B 15/06; D04B 15/18; D04B 35/04
USPC ..... 66/19, 20, 25, 28, 31, 104, 107
See application file for complete search history.

(56) References Cited

U.S. PATENT DOCUMENTS

| | | | | |
|---|---|---|---|---|
| 1,418,345 | A * | 6/1922 | Witherell | 66/95 |
| 2,622,421 | A * | 12/1952 | Minton | 66/24 |
| 2,626,515 | A * | 1/1953 | St Pierre | 66/95 |
| 4,580,419 | A * | 4/1986 | Vincoli | 66/123 |
| 6,122,938 | A | 9/2000 | Henning et al. | |
| 6,298,693 | B1 | 10/2001 | Schaffer | |

FOREIGN PATENT DOCUMENTS

GB 510356 A 7/1939

OTHER PUBLICATIONS

International Search Report and Written Opinion dated May 7, 2012.

* cited by examiner

*Primary Examiner* — Danny Worrell
(74) *Attorney, Agent, or Firm* — Thomas Horstemeyer, LLP

(57) ABSTRACT

A single cylinder circular knitting machine (1) for men's socks with needles on the dial, comprises a dial provided with a plurality of radial beams (146) which form radial seats (16) for the sliding of the dial needles (18). The beam (146) has a discharge groove (154) on the working side (148*a*), which the transfer spring (186) of the dial needle faces, which limits the raising of the needle.

10 Claims, 10 Drawing Sheets

0.35
0.12
192
18

CIRCULAR KNITTING MACHINE FOR MEN'S SOCKS, OF THE TYPE WITH NEEDLES ON THE DIAL

CROSS-REFERENCE TO RELATED APPLICATION

This application is the 35 U.S.C. §371 national stage of PCT application PCT/IB2011/055936, filed Dec. 23, 2011 which claims priority to Italian Patent Application No. BS2011A000001, dated Jan. 5, 2011, both of which are incorporated by reference in its their entirety.

The present invention relates to a single cylinder circular knitting machine for men's socks, of the type with needles on the dial.

As is known, circular knitting machines for men's socks divide into two main categories: single cylinder and double cylinder.

The first have simpler functioning and lower manufacturing and maintenance costs but do not perform some types of stitches which are permitted by the double cylinder machines.

The single cylinder machine with needles on the dial adds to the range of processing possible compared to the simple single cylinder machine, while not yet permitting all the processing performed by double cylinder machines.

However, some types of processing, such as those for making a knitted fabric with multicolour coloured decorations which require cutting of the coloured yarns, can only be performed on single cylinder machines, inasmuch as provided with a cutter above the cylinder.

Embodiment examples are described in the International Applications WO 2009/013773 and WO 2011/004310 in the Applicant's name.

Such machines have a large number of particularly thin needles on the dial which during the alternate movement assumed during processing highlight the tendency to slight deviations from the ideal direction, with the risk of jamming, breakage and malfunctioning.

The aim of the present invention is to make a single cylinder circular knitting machine for men's socks with needles on the dial which permits efficient guidance of such needles.

Such purpose is achieved by a single cylinder machine with needles on the dial, made according to claim 1.

The characteristics and advantages of the machine according to the invention will be evident from the description below made by way of a non-limiting example, according to the appended drawings wherein.

Figure 11A:
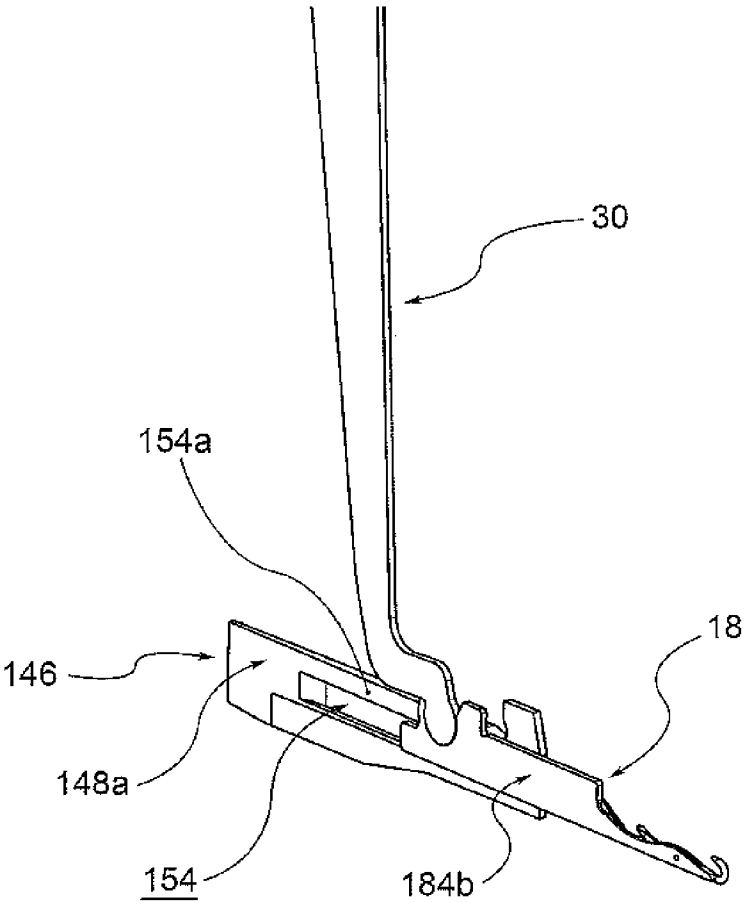
Figure 11B:
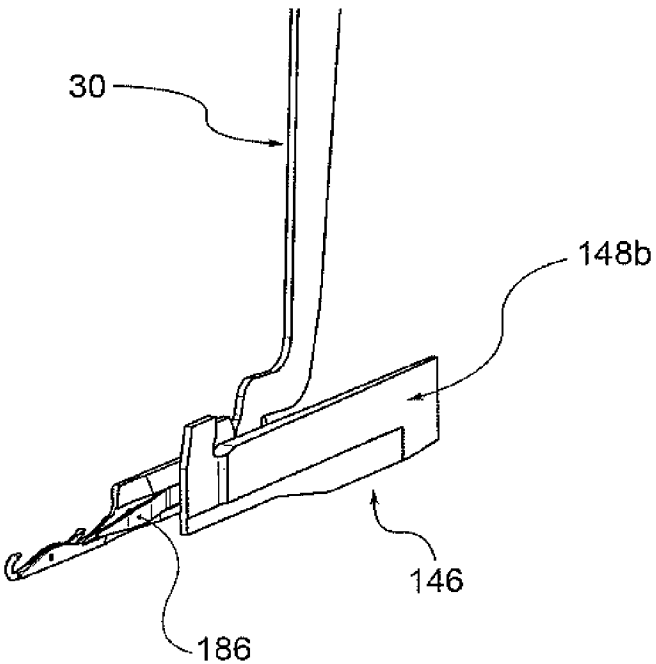
Figure 13:
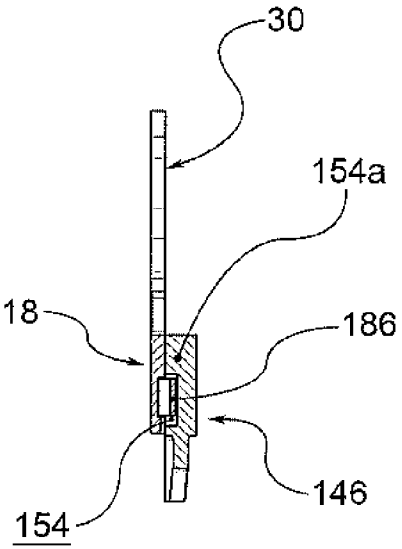
Figure 12:
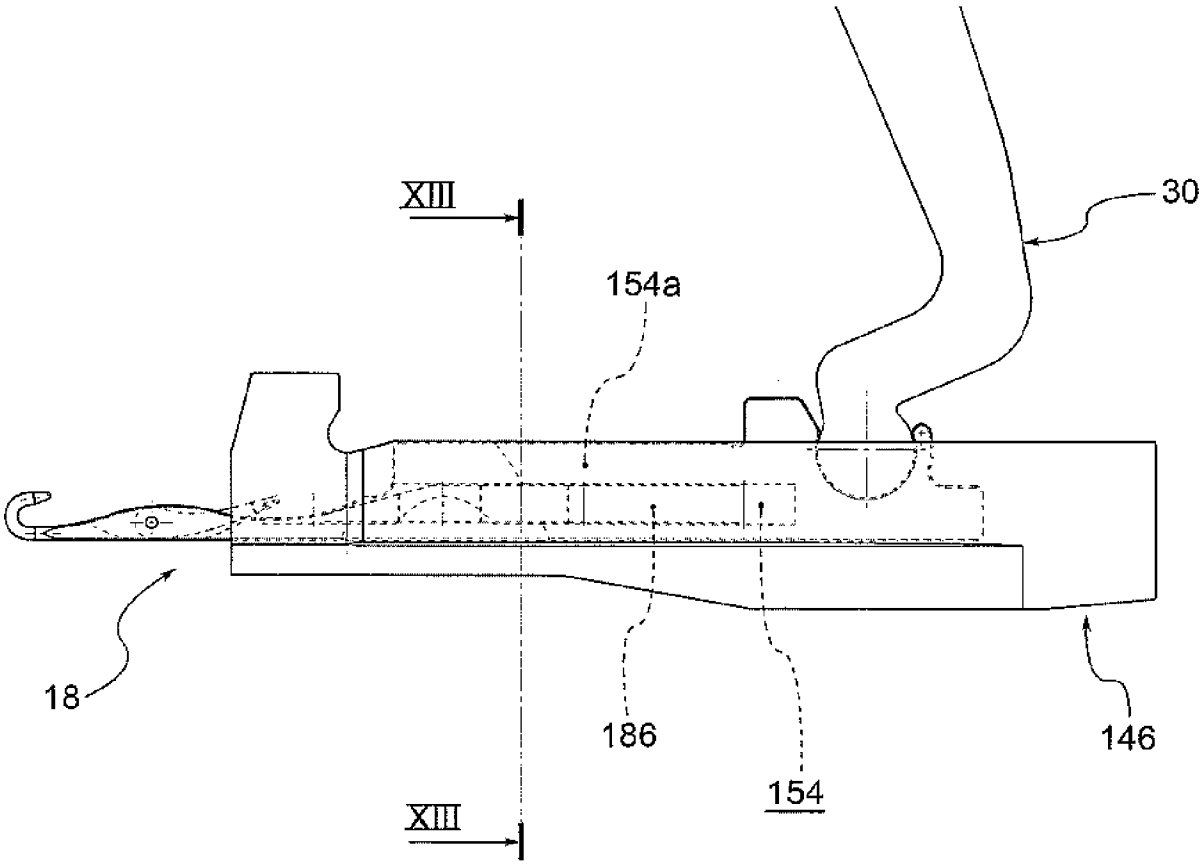

FIGS. 7*a*, 7*b*, 8*a* and 8*b* show embodiment variations of dial needles;

FIGS. 9*a*, 9*b*, 9*c* and 9*d* show further embodiment variations of dial needles, with some dimensions expressed in millimetres indicated by way of example;

FIGS. 10*a* to 10*h* show yet further embodiment variations of dial needles, with some dimensions expressed in millimetres indicated by way of example;

FIGS. 11*a* and 11*b* show a dial needle coupled to a relative selection rod, from two different observation points;

FIG. 12 shows a lateral view of an assembly comprising a beam, a dial needle and a selector rod; and FIG. 13 shows a transversal cross-section of the assembly in FIG. 12, according to the cross-section line XIII-XIII in FIG. 12.

According to the appended drawings reference numeral 1 globally denotes a single cylinder circular knitting machine for making men's socks.

The term "machine for men's socks" is taken to mean a type of machine for hosiery suitable for making articles in which the proportion between the nominal diameter of the threads or yarns used and the dimensions of the stitches is such as to yield a knitted fabric with a high coverage effect, that is to say with opposite characteristics to the traditional sheerness of ladies' stockings. In other words, the wording "men's socks" actually refers to an intrinsic characteristic of the article made and not to the use to which the same is effectively put.

The machine 1 comprises an internally hollow cylinder 2 having a rotation axis X, rotatable on command around said axis, and having a plurality of axial grooves 4 on its outer surface.

Furthermore, the machine 1 comprises a plurality of cylinder needles 6, held so as to be able to slide in said axial grooves 4 of the cylinder 2.

Moreover, the machine comprises a drum (not shown), coaxial to the cylinder 2 and positioned eternally to it, rotatable on command around the cylinder.

Furthermore, the machine 1 comprises cylinder needle moving means, able to impose a translation in alternate directions on the cylinder needles 6 between a lower limit position and an upper limit position, axially higher than the lower limit position.

The moving means comprise a plurality of cams, joined to the drum, provided with active surfaces which engaging sufficiently with the cylinder needles, cause them to be raised and/or lowered as needed.

Furthermore, the machine 1 comprises a fixed external crown 8, which surrounds the cylinder 2, coaxial with it, fitted with a plurality of crown grooves 10 positioned radially in relation to the rotation axis X.

The machine 1 further comprises a plurality of a plurality of sinkers 12, held so as to be able to slide in the crown grooves 10 and relative sinker moving means, able to impose translation of the sinkers in alternate directions between a rearward limit position and a forward limit position, radially internal to the rearward limit position.

The machine 1 further comprises a dial 14 positioned in such a way as to surmount the cylinder 2, coaxial with it, rotating on command around the rotation axis X of the cylinder 2.

In particular the machine comprises a dial shaft 15, which extends along the rotation axis X and surmounts the dial 14, joined at a lower end to said dial 14, to drag it in rotation, and engaged with motor means at the other end.

The dial 14 is provided with a plurality of radial seats 16, which extend radially, remaining inside an imaginary axial extension of the outer surface of the cylinder 2, as well as a plurality of dial needles 18, for example in the same number as the cylinder needles, housed so as to slide in the radial seats 16 of the dial 14.

Furthermore, the machine 1 comprises dial needle moving means, which can engage with said dial needles and able to impose translation in alternate directions on the dial needles between a rearward limit position and a forward limit position, radially external to the rearward limit position.

For example, the machine 1 comprises an annular cover 20, positioned above the dial 14, coaxial to it and fixed; the dial needle moving means comprise plurality of cams 22, joined to the cover 20, so that by rotating the dial, said cams 22 engage the dial needles imposing their radial translation.

The machine 1 further comprises at least one yarn-finger (not shown) able to feed at least one yarn for the creation of the sock.

The cylinder needles 6, the dial needles 18 and the sinkers 12 work together to interlace the yarn and form the stitches which compose the sock.

Furthermore, the machine 1 comprises comprising dial needle selector means suitable for selectively moving the dial needles to move them from a position of disengagement to a position of engagement, in which they are engageable by said dial needle moving means, involving the selected needles in the formation of the stitches and excluding those not selected.

In other words, the dial needle moving means have an active function only when the dial needles, and in particular the heel of the same, is located outside a predetermined radial position, defined as the engagement position; when however the dial needles, or heels of these, are positioned radially inside said predetermined radial position, the dial needle moving means are inactive, that is to say they cannot engage the dial needles.

The dial needle selector means are suitable for selectively moving (that is to say only some or all) the dial needles 18, so that the elected needles are engageable by the dial needle moving means.

According to a preferred embodiment, the selector means comprise a plurality of selector rods 30 oscillating on command, engageable with the dial needles 18 to select some of them.

Said rods 30, preferably in the same number as the number of the dial needles, surmount the cylinder 2 and the dial and are positioned annularly around the rotation axis X of the cylinder 2.

Preferably the rods 30 are engaged with the dial needles 18 by means of a mechanical restraint, preferably bidirectional in a radial direction. In particular, an engagement end of the rod 30 is hinged to the dial needle, so that said dial needle 18 is constrained in radial translation to the end of the rod 30, but rotationally released from it.

Preferably moreover the selector means comprise selector command means suitable for selectively moving at least one of said rods 30, to select the corresponding dial needle.

Preferably moreover the machine 1 comprises cutting means, positioned on the dial 20, suitable for cutting the yarn.

According to a further embodiment variation, the cylinder needles 6 comprise a) a stem 50 having its main extension along the rotation axis X, between a lower end 50*a* (heel), which can be influenced by the cylinder needle moving means, and an upper end 50*b*, engageable with the dial needles 18 and the sinkers 12 for the formation of the stitch;

b) a hook and a tongue, at the upper end 50*b* of the stem; the tongue is hinged to the stem 50 in a hinging point, so as to close back onto the hook to form the space for the yarn;

c) a transport prominence 60, projecting externally from the stem 50, positioned below the hinging point of the tongue suitable for engaging a stitch in the passage from the lower limit position to the upper limit position.

Figure 1:
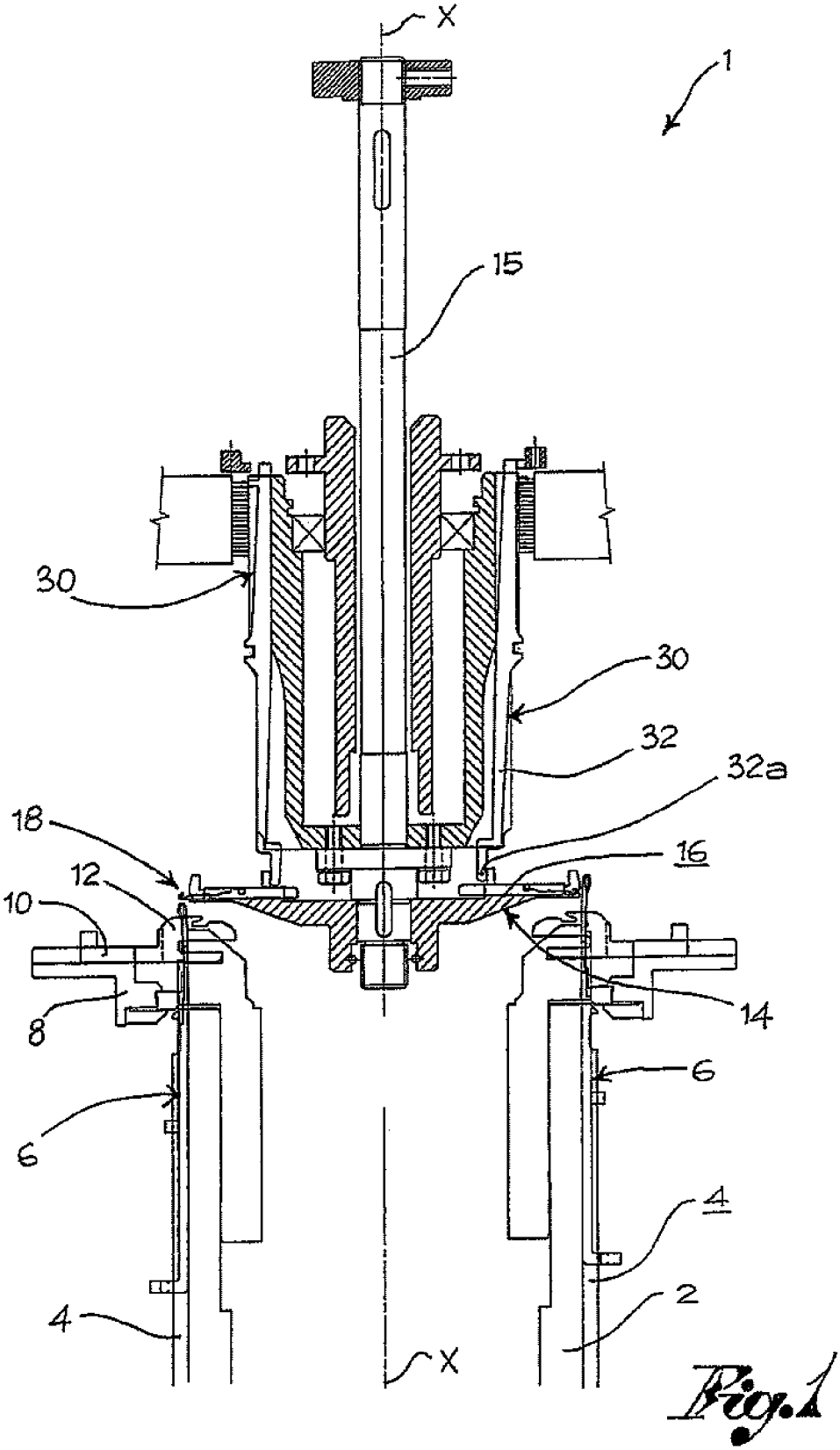
FIG. 1 shows a cross-section of the machine according to one embodiment variation of the present invention.
Figure 2:
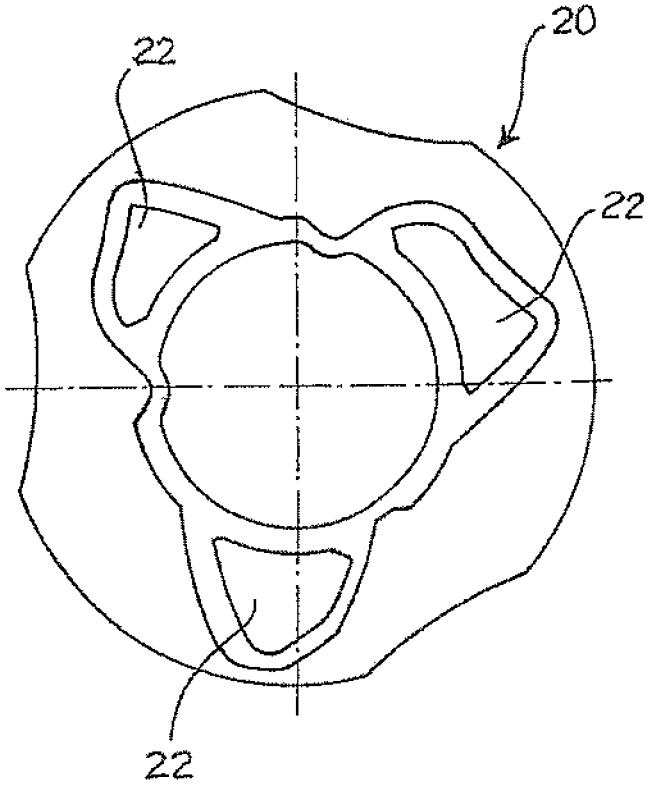
FIG. 2 shows a view of a dial of the machine in FIG. 1, comprising dial needle movement means.
Figure 3:
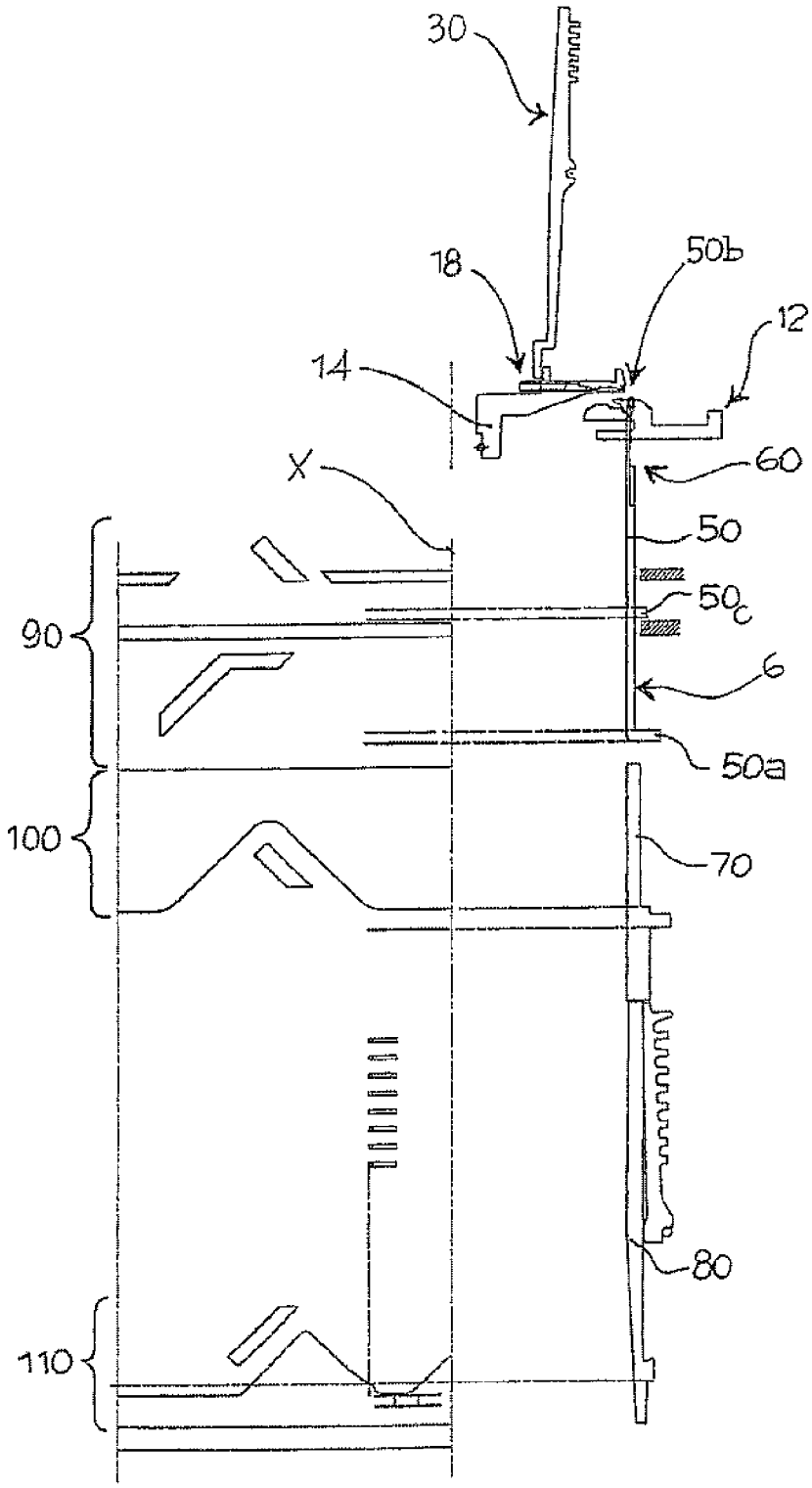
FIG. 3 shows a diagram of a processing phase of the machine according to the present invention.

The transport prominence 60 is positioned long the stem 50 in such a way that in the upper limit position of the cylinder needle, said transport prominence is situated above the working end of the dial needle 18 (FIG. 3*d*), to permit the transport of the stitch from the cylinder 2 to the dial 14.

Preferably the cylinder needle has a first heel 50*a* at the lower end of the stem and a second heel 50*c* between the first heel 50*a* and the transport prominence 60, suitable for being engaged by the cylinder needle moving means to move the cylinder needle 6 to the upper limit position, such as to raise the needle up to an optimal position for the transport of the stitch from the cylinder needle to the dial needle.

In addition, the cylinder needle moving means comprise a plurality of cam groups for the translation of the cylinder needles 6.

Preferably moreover the machine 1 comprises means of traction suitable for exercising a pulling effect on the sock being formed.

Figure 4:
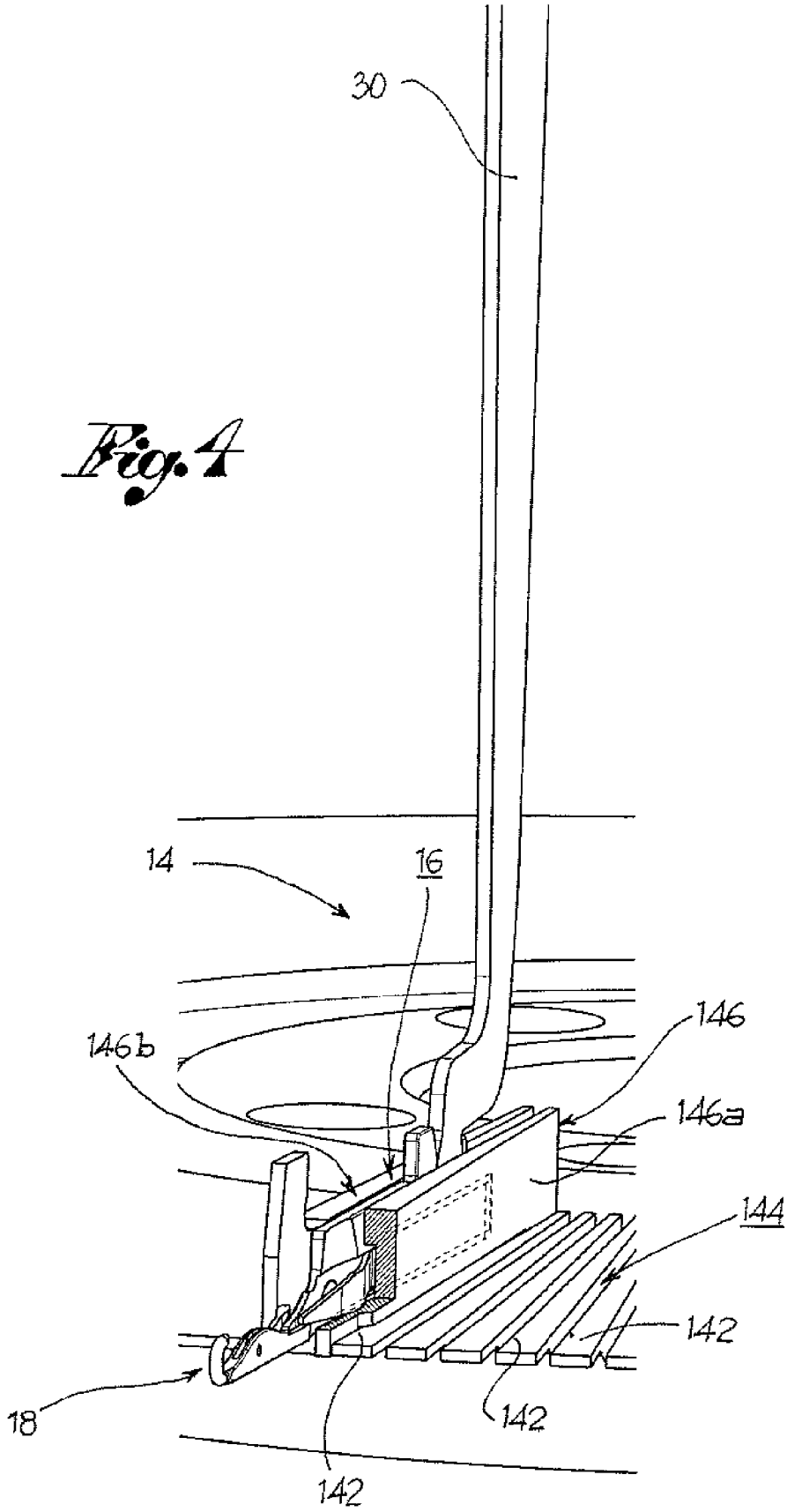
FIG. 4 shows a portion of the dial zone.

More in detail, the dial 14 comprises a plurality of steps 142 which extend radially from the periphery to the centre of the dial, angularly distanced so as to form between these radial seats 144 (FIG. 4).

The dial 14 further comprises a plurality of thin, elongated beams 146, positioned in the radial seats 144, so that between a first beam 146*a* and a subsequent beam 146*b* the seats 16 for the dial needles 18 are formed.

Figure 5:
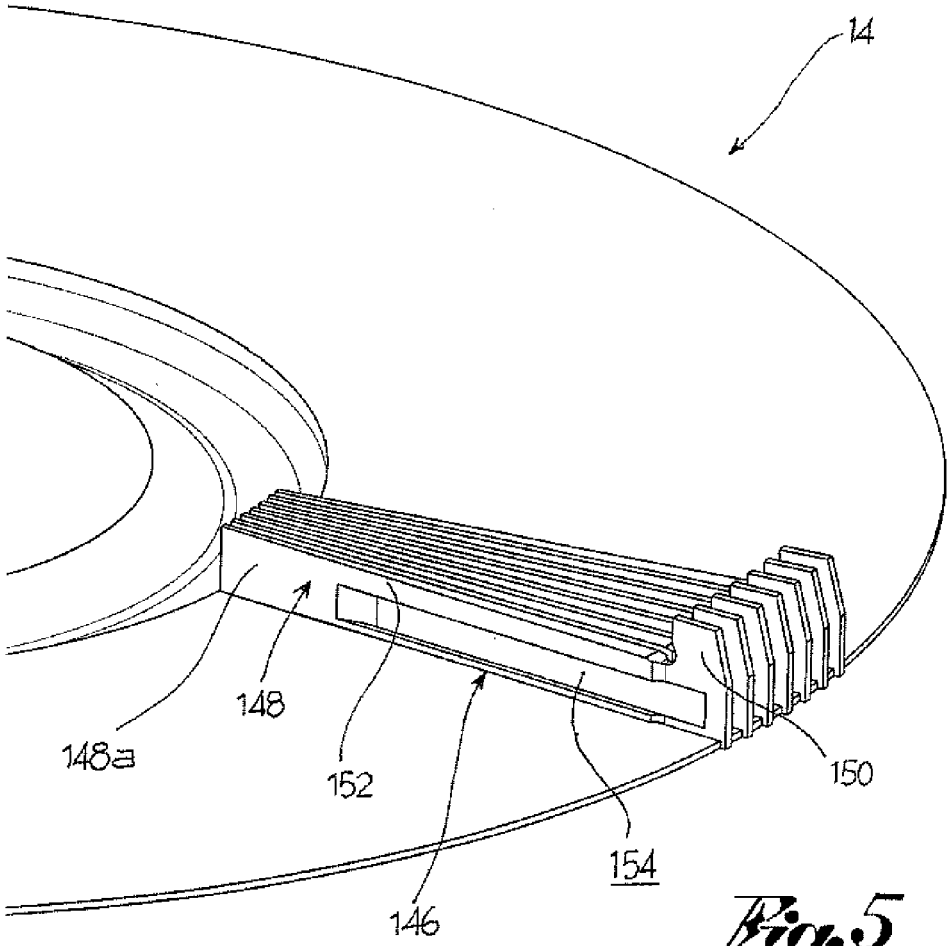
FIGS. 5 and 6 show beams of the dial.
Figure 6:
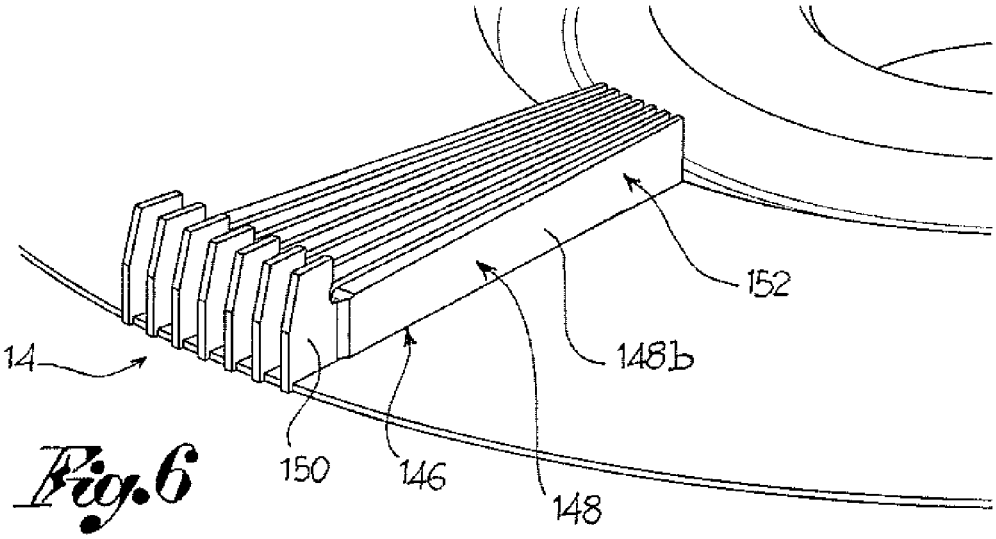
Figure 8B:
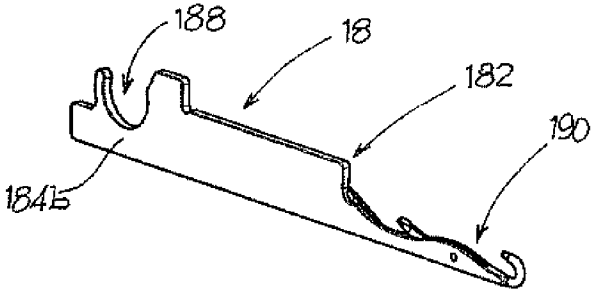
Figure 7B:
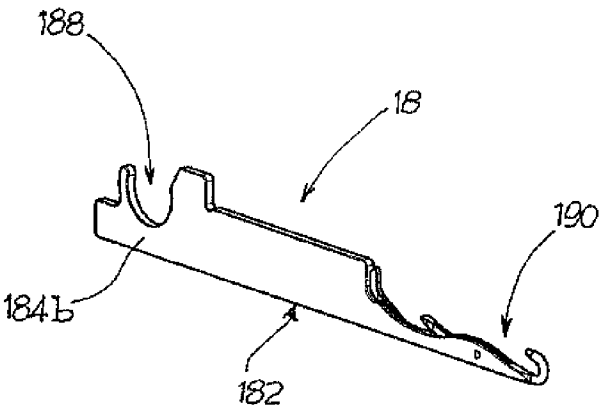
Figure 8A:
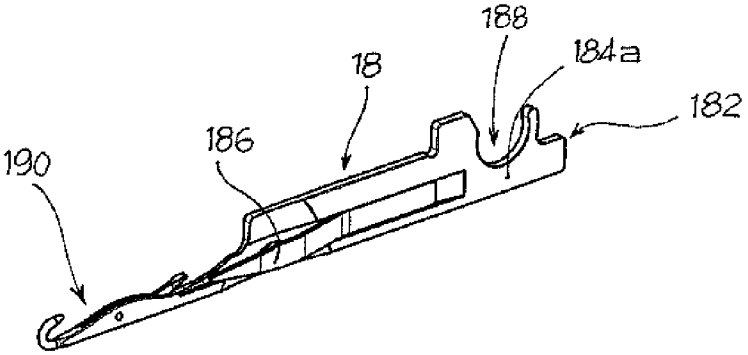
Figure 7A:
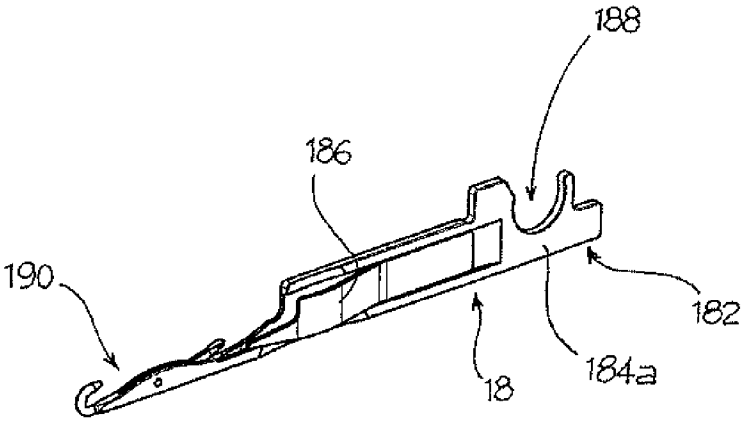

The beam 146 comprises a main body 148, which on one side has working side 148*a* and on the other side has a substantially smooth secondary side 148*b* (FIGS. 5 and 6).

The main body 148 comprises a slim head 150 positioned at the peripheral end of the beam 146 and a stem 152, lowered in relation to the head 150 and thicker, extending from the head 150 to the end of the beam next to the centre of the dial.

The working side 148*a* has a groove 154 which extends along the beam 146, for most of the stem 152 and preferably also at least part of the head 150.

Preferably, the groove 154 is closed at the end, in other words is not passable from the working side 148*a* of the beam 146 to the secondary side 148*b* of said beam.

According to one embodiment variation, rather, the groove is at least partially passable.

Preferably the seat 16 has an angular extension such as to allow the entrance of the end section of the respective rod 30 for the selection of the corresponding dial needle 18.

The dial needle 18 comprises a slim main body 182 extending in a rectilinear direction X, positioned radially when the dial needle 18 is housed in its respective seat 16 (FIG. 7*a*, 7*b*, 8*a*, 8*b*).

In particular, the main body 182 has on one side has working side 184*a* and on the other side a secondary side 184*b*.

The secondary side 184*b*, is substantially smooth, that is without prominences.

Conversely, the dial needle 18 comprises a transfer spring 186, projecting from the working side 184*a* of the main body 182, alongside the body itself.

The transfer spring 186 acts in conjunction with the cylinder needles 6 and the sinkers 12 for the passage of the stitch from the dial needles to the cylinder needles and vice versa.

Moreover, the main body 182 comprises a heel 188 suitable for engaging with the rod 30 to select the needle, and head 190 which has a hook and an oscillating clasp for the formation of the stitch.

Figure 9B:
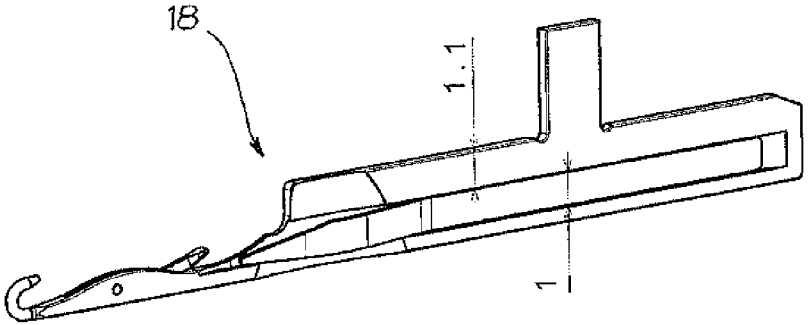
Figure 9A:
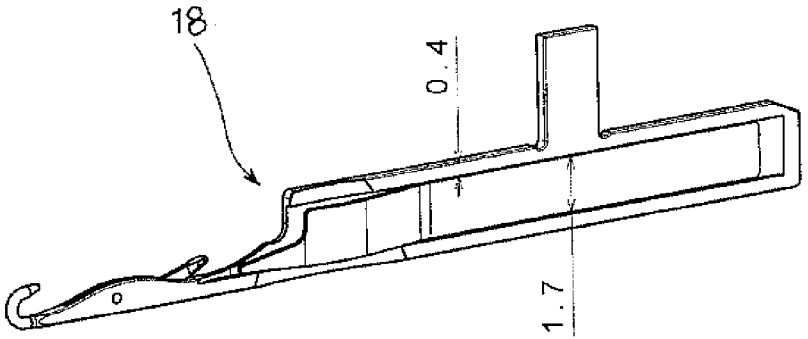
Figure 9D:
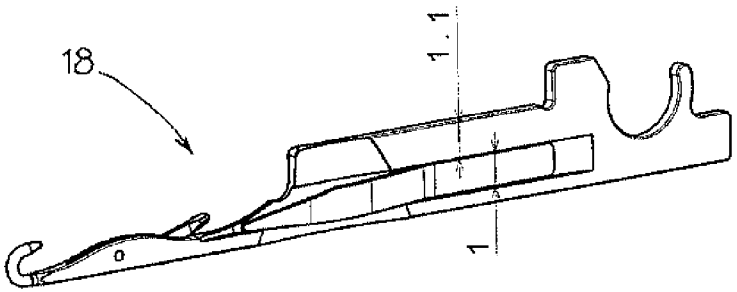
Figure 9C:
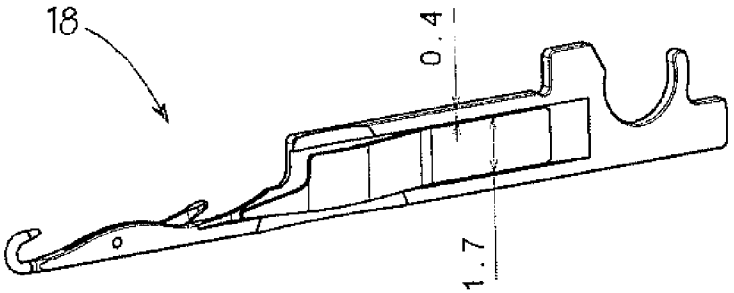
Figures 10A, 10B, 10C, 10D, 10E, 10F, 10G, 10H:
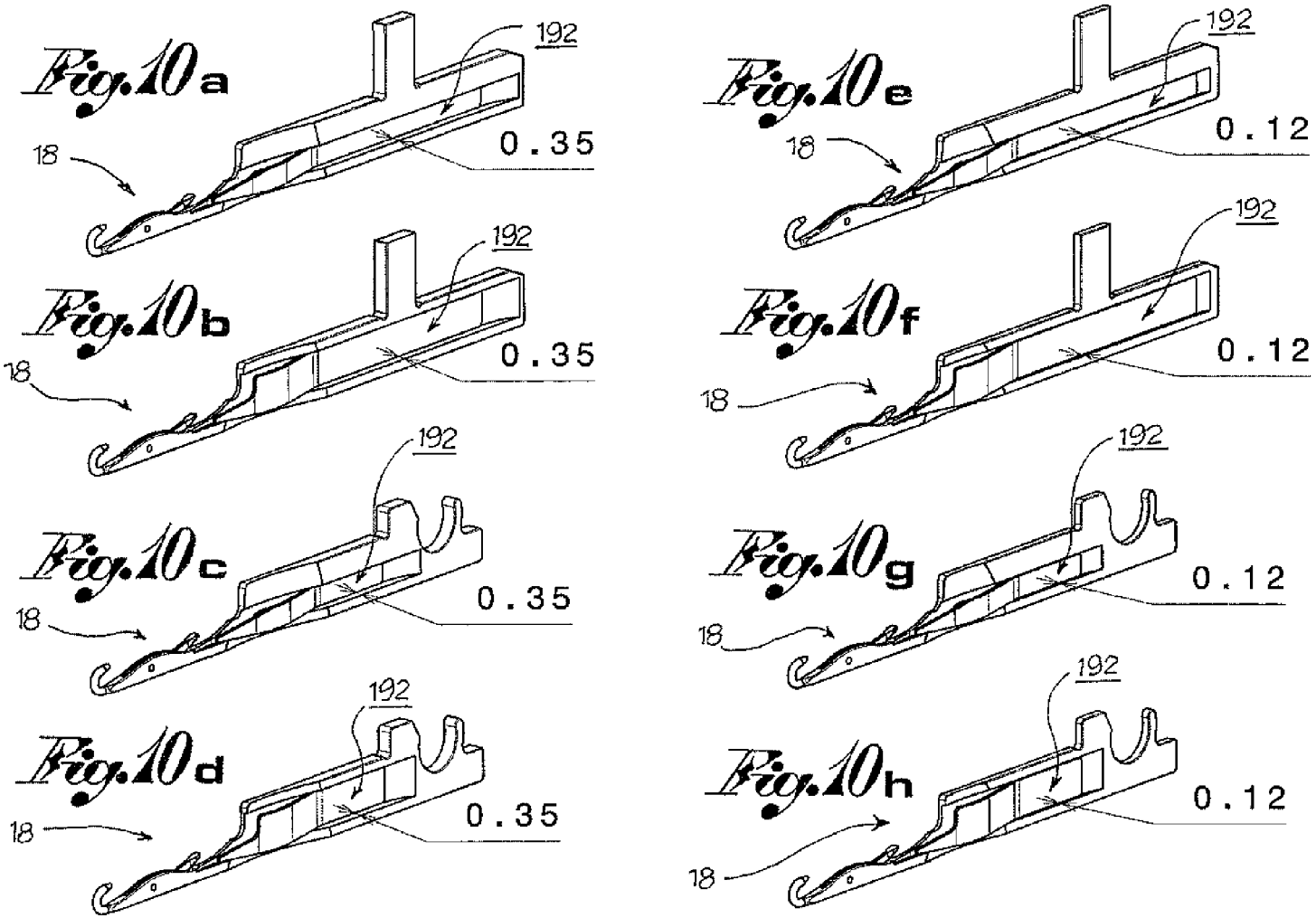

According to one embodiment, the dial needle is of the traditional type with heel for a monodirectional constraint (FIG. 9*a*) or of the lowered type with heel for monodirectional constraint (FIG. 9*b*), or it is of the traditional type with seat for bidirectional constraint (FIG. 9*c*) or of the lowered type with seat for bidirectional constraint (FIG. 9*d*).

The transfer spring 186 of the dial needle 18 faces the respective groove 154 of the beam 146, thereby preventing the dial needle and the beam from touching and giving rise to interferences with the movement of the dial needle.

According to a further embodiment of the present invention, the dial needle 18 has a discharge groove 192 on the working side 184*a*, which extends from the transfer spring 186 towards the tail end of the dial needle.

The discharge groove 192 of the dial needle 18 is facing the respective side of the beam 146, preferably smooth like the secondary side, thereby preventing the dial needle and the beam from touching.

For very thin dial needles the depth of the groove 192 is extremely limited, for example 0.12 millimetres; for thicker dial needles, the depth of the groove is greater, for example 0.35 millimetres.

According to embodiment variations, the dial needles provided with discharge grooves are of the traditional or lowered type, with heel for monodirectional constraint or seat for bidirectional constraint (FIGS. 10*a* to 10*h*).

Preferably, the groove 154 is delimited upwards by a top wall 154*a* which limits the vertical movement of the dial needle 18.

In particular, in the case of rising of the dial needle, the transfer spring 186 touches the top wall 154*a* and is limited by this from further raising.

Advantageously such characteristic makes it possible to limit or eliminate the raising of the dial needle during the travel from the retracted limit position to the advanced limit position.

Such advantage is particularly evident in the embodiments which envisage a bidirectional constraint between the dial needle and the rod, in that said bidirectional constraint tends to raise the tip of the needle during the travel from the limit retracted position to the limit advanced position.

Innovatively, the machine according to the present invention makes it possible to have a large number of dial needles without jamming or malfunctioning occurring as a result of the movement of such needles.

Advantageously moreover by limiting the rubbing between the dial needles and the respective beams, the invention makes it possible to prevent localised overheating of the dial.

According to a further advantageous aspect the invention makes it possible to limit or eliminate the raising of the dial needle during the travel from the retracted limit position to the advanced limit position. Such advantage is particularly evident in the embodiments envisaging a bidirectional constraint between the dial needle and the rod.

It is clear that a person skilled in the art may make modifications to the machine described above so as to satisfy contingent requirements.

For example, according to one embodiment variation, the beam has a discharge groove on each side.

Such variations are also contained within the sphere of protection as defined by the following claims.

The invention claimed is:

1. A single cylinder circular knitting machine for making men's socks, comprising:

a cylinder having a rotation axis, rotatable on command around the axis, and having a plurality of axial grooves on the outer surface;

a plurality of cylinder needles, held so as to be able to slide in the axial grooves of the cylinder;

cylinder needle moving means, able to impose a translation in alternate directions on the cylinder needles between a lower limit position and an upper limit position, axially higher than the lower limit position;

a fixed external crown, which surrounds the cylinder, coaxial with it, fitted with a plurality of crown grooves;

a plurality of sinkers, held so as to be able to slide in the crown grooves;

sinker moving means able to impose translation of the sinkers in alternate directions between a rearward limit position and a forward limit position, radially internal to the rearward limit position;

a dial, positioned in such a way as to surmount the cylinder, coaxial with it, rotating on command around the rotation axis of the cylinder, comprising a plurality of beams positioned radially, angularly distanced, so as to form between two successive beams, radial seats which extend radially internally to the outer surface of the cylinder, wherein the beam has a working side and an opposite secondary side;

a dial shaft, connected to the dial to drag it in rotation;

a plurality of dial needles, held so that they can slide in the radial seats of the dial, comprising a main body positioned radially and a transfer spring, projecting from the main body, for the transfer of the stitch during processing;

dial needle moving means, which can engage with the dial needles and able to impose translation in alternate directions on the dial needles between a rearward limit position and a forward limit position, radially external to the rearward limit position;

at least one yarn-finger able to feed at least one yarn for the creation of the sock;

wherein the cylinder needles, the dial needles and the sinkers work together to interlace the yarn and form the stitches which compose the sock;

and wherein the beam has a first discharge groove on the working side, which the transfer spring of the dial needle faces, the first groove being provided with a top wall which limits the vertical movement of the dial needle.

2. Machine according to claim 1, wherein the top wall limits the vertical movement of the transfer spring.

3. Machine according to claim 1, wherein the beam comprises a slim head positioned at the peripheral end of the beam and a stem, lowered in relation to the head and thicker, extending from the head to the end of the beam next to the centre of the dial, wherein the first discharge groove extends along the beam, for most of the stem.

4. Machine according to claim 1, wherein the first discharge groove is closed at the end, in other words is not passable from the working side of the beam to the secondary side of the beam.

5. Machine according to claim 1, wherein the first discharge grove is at least partially passable.

6. Machine according to claim 1, wherein the dial needle has a second discharge groove which extends from the transfer spring towards the tail end of the dial needle, facing the respective side of the beam.

7. Machine according to claim 1, comprising dial needle selector means suitable for selectively moving the dial needles to move them from a position of disengagement to a position of engagement, in which they are engageable by the dial needle moving means.

8. Machine according to claim 7, wherein the selector means comprise a plurality of selector rods oscillating on command, engageable with the dial needles to select some of them.

9. Machine according to claim 8, wherein the dial needle has a seat for a bidirectional constraint with a respective selector needle of the dial needle selector means.

10. Machine according to claim 3, wherein the first discharge groove extends along the beam for at least part of the head.

* * * * *